United States Patent [19]

Glöersen

[11] 4,284,120

[45] * Aug. 18, 1981

[54] METHOD AND DEVICE FOR TRANSFER OF FIBER MATERIALS TRANSPORTABLE BY LIQUIDS

[76] Inventor: Stig Glöersen, Edsgatan, POB 4502, Karlstad, Sweden

[ * ] Notice: The portion of the term of this patent subsequent to Mar. 14, 1995, has been disclaimed.

[21] Appl. No.: 32,459

[22] Filed: Apr. 23, 1979

Related U.S. Application Data

[63] Continuation of Ser. No. 830,206, Sep. 2, 1977, abandoned.

[30] Foreign Application Priority Data

Sep. 3, 1976 [SE] Sweden ..... 7609782

[51] Int. Cl.[3] ..... D21C 7/06; D21C 7/14

[52] U.S. Cl. ..... 162/19; 162/52; 162/237; 162/246; 222/370; 414/298; 414/301

[58] Field of Search ..... 162/17, 19, 52, 246, 162/237, 251; 214/17 CB, 17 CC; 222/194, 370

[56] References Cited

U.S. PATENT DOCUMENTS

| | | | |
|---|---|---|---|
| 3,530,034 | 9/1970 | Erickson | 162/19 |
| 3,537,953 | 11/1970 | Brown et al. | 162/52 |
| 3,589,521 | 6/1971 | Richter | 162/251 |
| 3,755,072 | 8/1973 | Östberg et al. | 162/237 |
| 4,057,461 | 11/1977 | Richter | 162/52 X |
| 4,078,964 | 3/1978 | Gloersen | 162/52 X |

FOREIGN PATENT DOCUMENTS

| | | | |
|---|---|---|---|
| 165679 | 12/1958 | Sweden | 162/52 |

*Primary Examiner*—S. Leon Bashore
*Assistant Examiner*—Steve Alvo
*Attorney, Agent, or Firm*—Birch, Stewart, Kolasch & Birch

[57] ABSTRACT

There is disclosed a process for the transfer of fiber material from one circuit of circulating liquid to another, where the fiber material is transported by circuits positioned at right angles to the axis of rotation of a rotary transfer or feed valve and the circulating, transporting liquids are screened off through self-cleaning screens. The transfer valve contains a pocket and three working positions, a filling circuit, an emptying circuit, and an intermediate position for preheating the fiber material or providing a temperature lock depending upon the rotation of the pocket.

8 Claims, 14 Drawing Figures

FIBER MATERIAL AND LIQUID FROM EMPTYING CIRCUIT
26
FIBER MATERIAL INLET
23
TRANSPORT LIQUID FOR EMPTYING CIRCUIT
TRANSPORT LIQUID FROM FILLING CIRCUIT
27
25
21
16
LRC
28
RECIRCULATED LIQUID TO EMPTYING CIRCUIT
24
TRANSPORT LIQUID FROM FILLING CIRCUIT

METHOD AND DEVICE FOR TRANSFER OF FIBER MATERIALS TRANSPORTABLE BY LIQUIDS

This application is a continuation of copending application Ser. No. 830,206, filed on Sept. 2, 1977, now abandoned.

BACKGROUND OF THE INVENTION

The present invention is concerned with a method for transfer of fiber material from one circuit of circulating liquid to another, where the fiber material is transported by circuits positioned at right angles to the axis of rotation of a rotary feed valve and the circulating liquids for effecting transport of the fiber material are screened off through self-cleaning screens located in the feed valve housing, and where the fiber material is transported into and out of the feed valve by circulating liquids that are screened off through self-cleaning screens.

When feeding cellulosic fiber material and liquid into a pressurized treatment vessel, preferably of continuously operating type, such as a digester for pulp making, it is a known practice to use feed valves for transferring the material. The method of transfer is such that the feed valve rotor, being provided with one or more pockets, is brought into various positions in which the pocket or pockets communicate with circulation lines between different treatment vessels.

The purpose of the present invention is to make available an improved method for transferring fiber material between the circulation lines, thereby obtaining improved means of control, more even and less temperature-sensitive feed of the fiber material, lower energy requirement, a final product, such as pulp, of more even quality, and higher pulp yield. The invention also permits more variation in the nature of the raw materials; for example, larger amounts of sawdust and of green chips can be used in the cooking process without causing trouble in the feed system.

SUMMARY OF THE INVENTION

This is achieved by endowing the method of the invention with the characteristics stated in the appended claims. There is disclosed a process for the transfer of fiber material from one circuit of circulating liquid to another, where the fiber material is transported by circuits positioned at right angles to the axis of rotation of a rotary transfer or feed valve and the circulating, transporting liquids are screended off through self-cleaning screens. The transfer valve contains a pocket and three working positions, a filling circuit, an emptying circuit, and an intermediate position for preheating the fiber material or providing a temperature lock depending upon the rotation of the pocket.

In the following paragraphs the invention will be described in more detail in conjunction with the appended drawings, which illustrate various examples of systems in which the method of the invention is applied. The drawings are presented so as to illustrate the instant invention, and thus are not limitative of the present invention. Of the drawings, FIG. 1 is a schematic view of a continuous digester house having a feed valve or rotary valve in both the feed-in stage and the heating stage.

Figure 1:
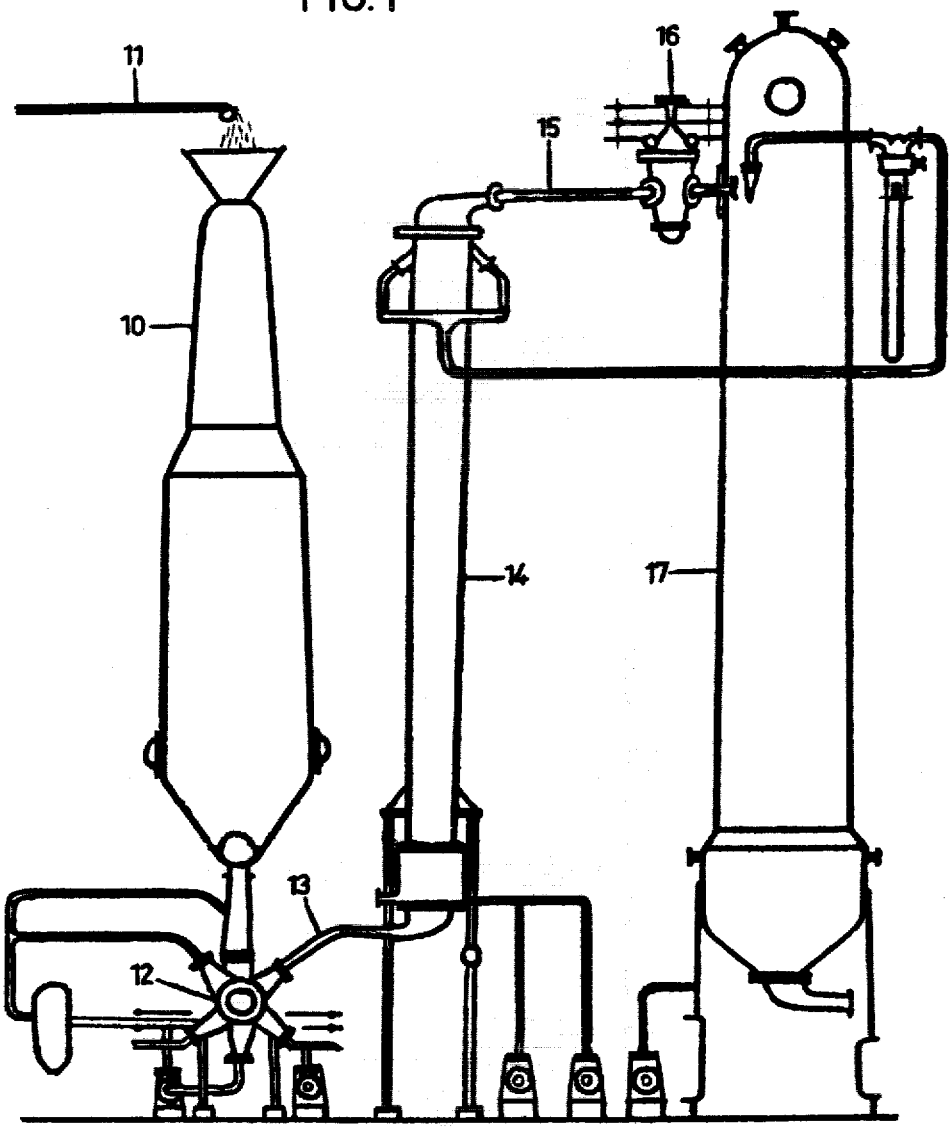
Figure 9:
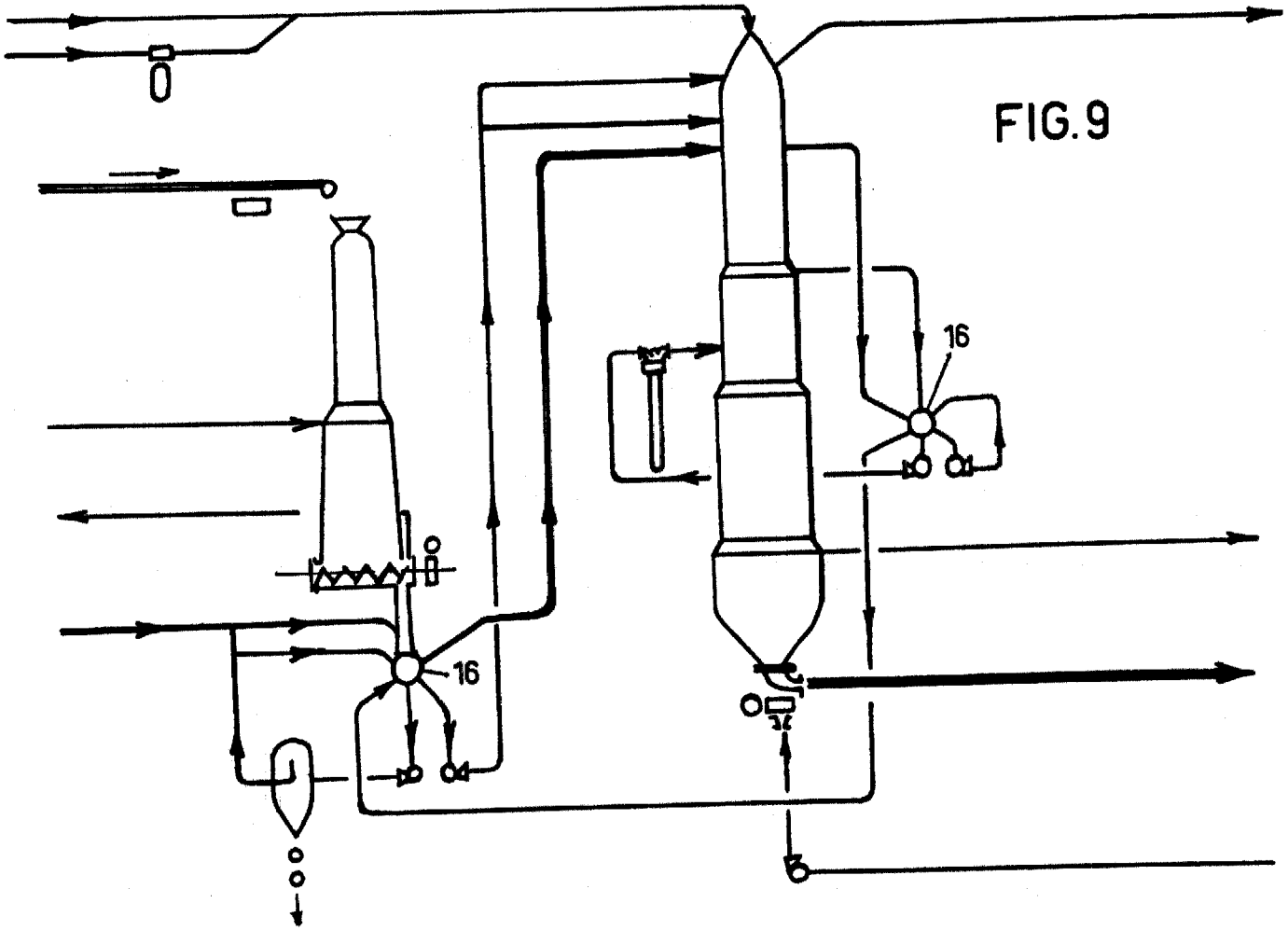
Figure 10:
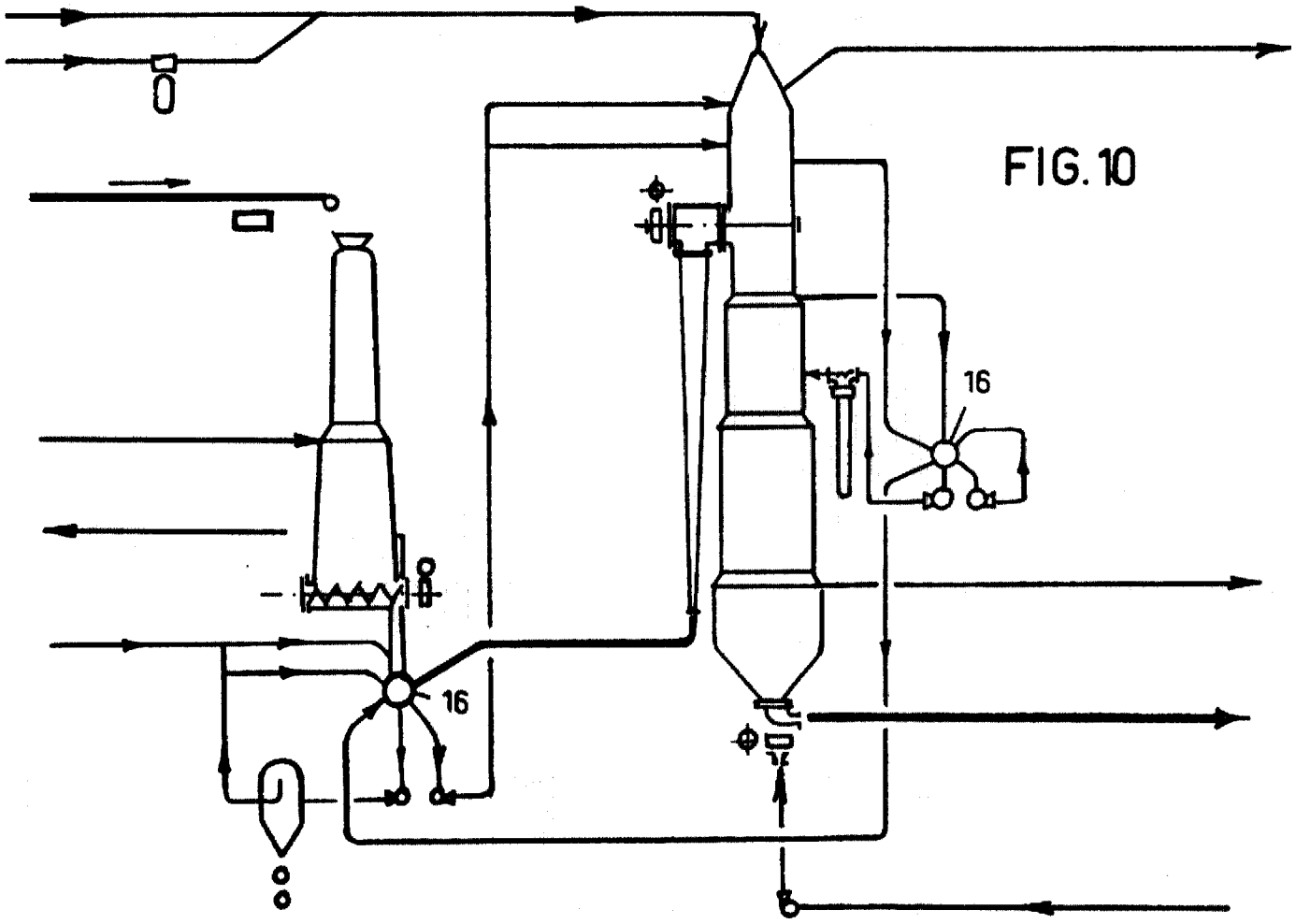

In FIG. 1, 10 denotes a pretreatment vessel, such as a steaming vessel, fed by a conveyor 11 with fiber material, such as wood chips. At the bottom of the vessel 10 a feed or rotary valve 12 is provided which has three inlet fittings and three outlet fittings as described more closely below. One of the inlet fittings is connected to the outlet of the vessel 10, while one of the outlet fittings of the valve is connected to a line 13 leading to the base of a treatment vessel 14, such as an impregnating vessel. The fiber material treated in the vessel 14 rises to the upper part of the vessel, where there is an outlet which is connected via a line 15 to another feed valve 16 similar to feed valve 12 and one outlet of which is connected to a following treatment vessel 17 such as a digester or similar. The material treated in vessel 17 is tapped at the base of the vessel, following cooling and prewashing, and is fed to the next stage of treatment in a manner known per se or via the valve of the invention. The figure also shows lines, not labeled in detail, for the extraction and recycling of treatment liquids between the vessels, as will be described in more detail below in connection with the flow charts shown in FIGS. 3 to 11.

Figure 2:
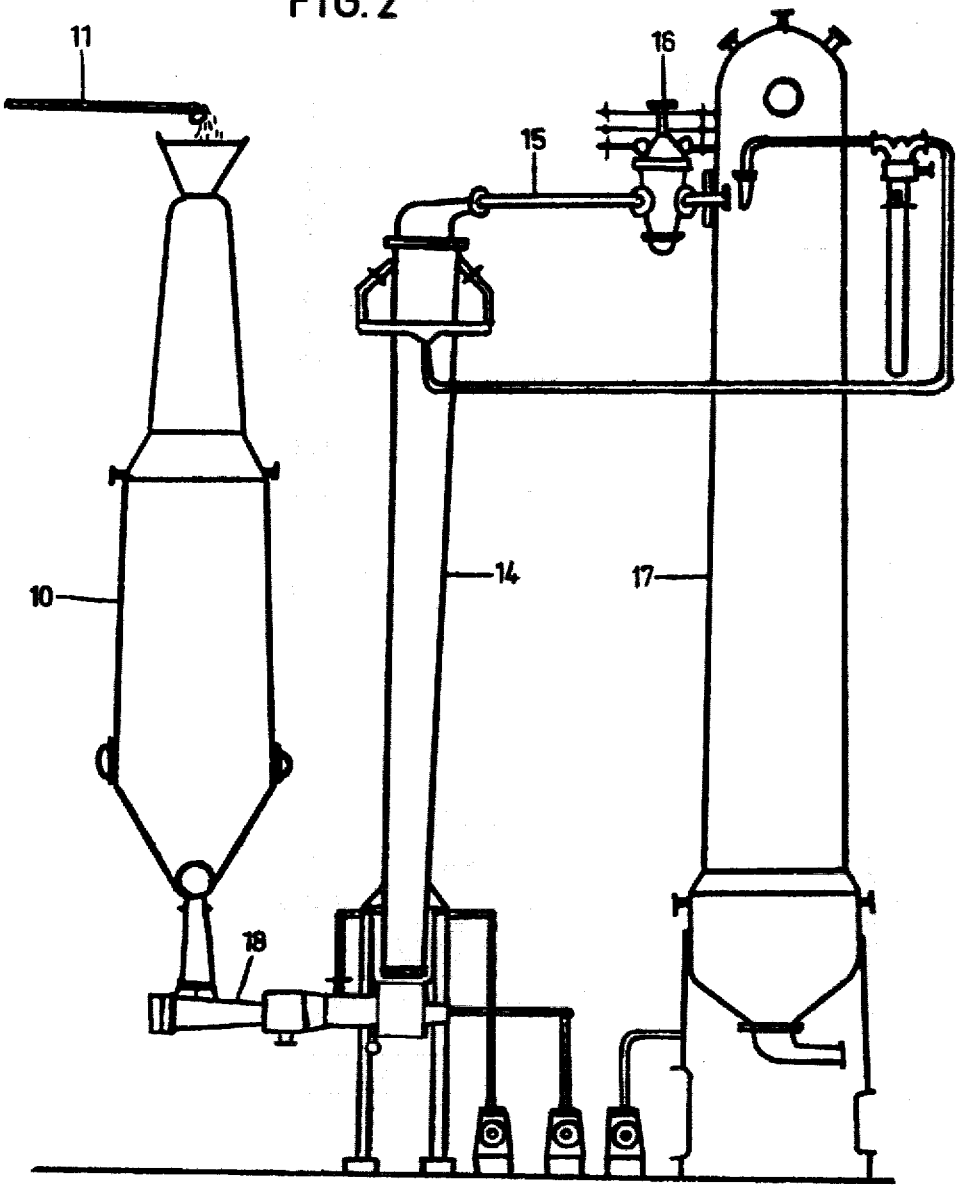
FIG. 2 shows a view similar to FIG. 1 of a plant with a feed screw at the feed-in stage and with a feed valve at the heating stage.

In FIG. 2, where parts shared with FIG. 1 are furnished with the same reference labels, the transfer of material between treatment vessel 10 and treatment vessel 14 is effected by a feed screw 18 instead of a feed valve. Otherwise, the plant is constructed in the same manner as the plant of FIG. 1.

Figure 3A:
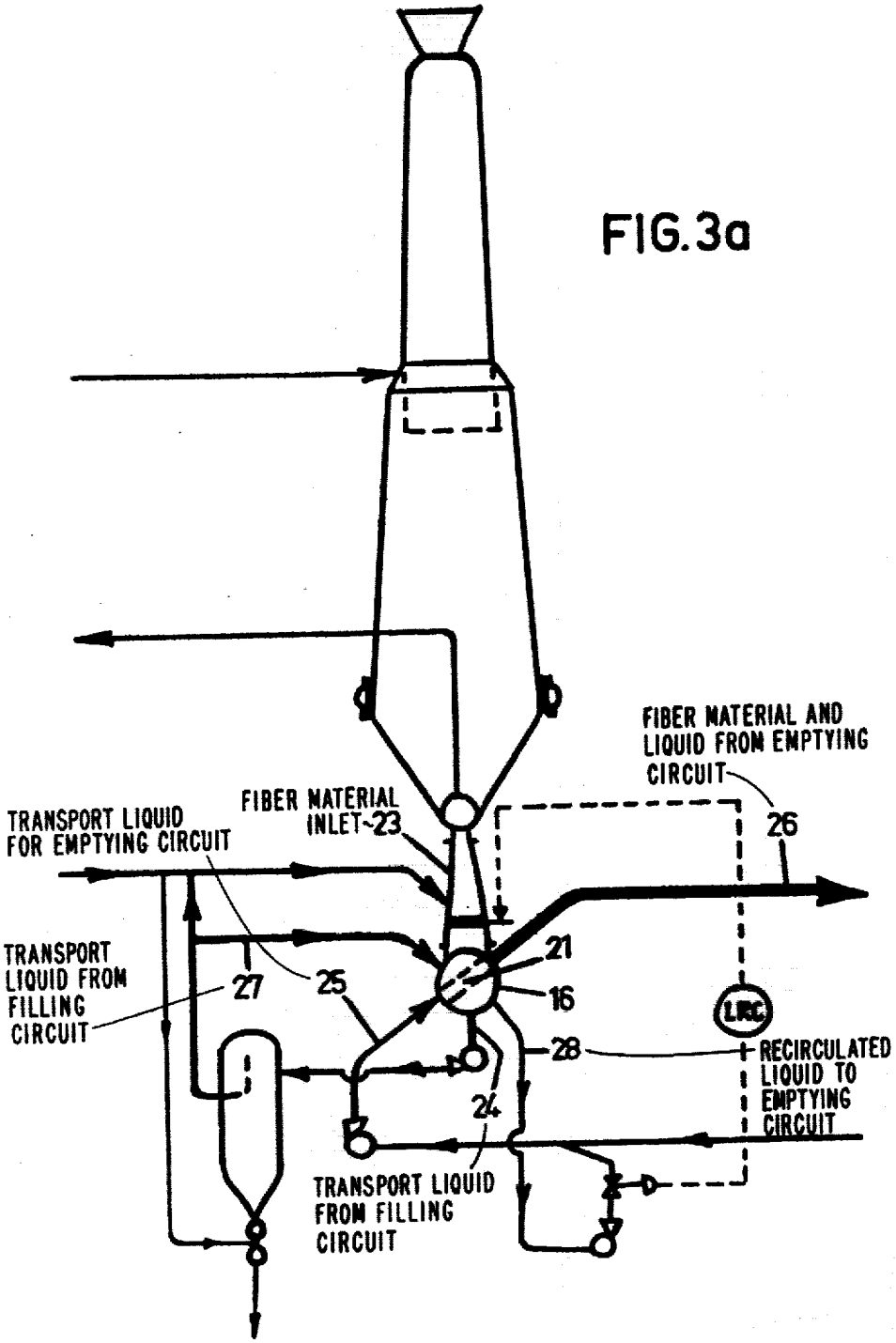
FIGS. 3 to 11 show examples of flow-charts for various plants operating in accordance with the invention.
Figure 12:
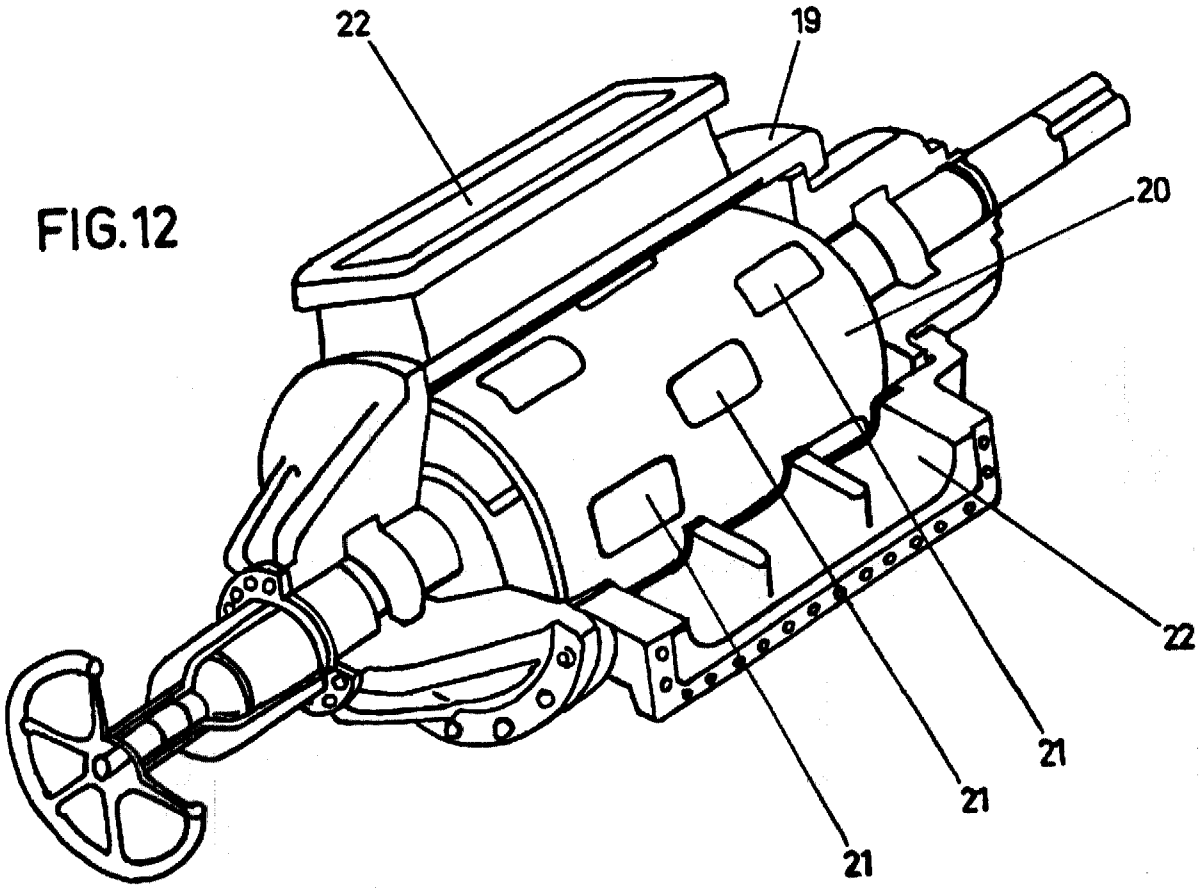
FIG. 12 is a perspective drawing of a feed valve or rotary valve for carrying out the procedure of the invention.

FIG. 3*a* shows the feed-in section of the plants of FIG. 1. The fiber material admitted via the feed valve or via the so-called silent digester valve 16 may be fed either into an impregnating vessel (incorporated in the digester or free-standing) or straight into the digester. As is apparent from FIG. 12, which shows a section of the valve in perspective, the tap comprises a housing 19 containing a rotating rotor 20 powered in an appropriate manner. The rotor 20 is provided with one or more through pockets 21 which by the rotation of the rotor are brought into communication with openings leading to connection fittings 22 around the circumference of the housing. As shown in FIG. 12, the rotor has a number of pockets that are spaced at regular intervals about the circumference of the rotor in order to achieve an even flow of material through the feed or rotary valve. The valve housing is provided with one or two screening devices (not shown), depending on the application of the valve. For the sake of simplicity, however, the case of a rotor having only one pocket 21 will be assumed in the following description.

According to the invention, and as shown in detail in FIG. 3*a*, the fiber material feed is effected through the pocket 21 being brought periodically into communication with the fiber material inlet 23, whereby the pocket is filled and the transporting liquid (for the filling circuit) is drawn off via a line 24 through a self-cleaning screen. After this, the rotor 16 rotates into the position illustrated in the figure, where a transporting liquid (the emptying circuit) supplied via a line 25 carries the chips or fiber material out of the pocket 21 and through a line 26 to the digester. Then, the pocket 21 moves on to the third position, where part of the liquid extracted from the filling circuit via a second self-cleaning screen incorporated in the valve or in the circulation line is used to increase the volume of liquid in the emptying circuit via lines 27, 28 and 25.

This procedure provides a very effective temperature lock between steaming and impregnation, allowing the use of temperatures below 100° C. in the filling circuit and temperatures above 100° C. in the emptying circuit, since boiling in the filling circuit is prevented by the pressurization of the extraction system as the liquor is displaced from the filling circuit in the valve to the emptying circuit. The emptying circuit may be cooled, for example, by heat transfer to the washing liquor supplied to the base of the digester or of a separate washtank. Puffs of steam are also prevented in the filling circuit by supplying the cooking liquor to the cooking process via the filling circuit. This type of feed will also permit vacuum treatment of the fiber material in the steaming vessel, enabling quicker and more effective removal of air from the fiber material. A concentration of turpentine in the cooking process can be avoided by the use of e.g. hot air and/or fresh, turpentine-free low-pressure steam for soaking the fiber material.

Figure 3B:
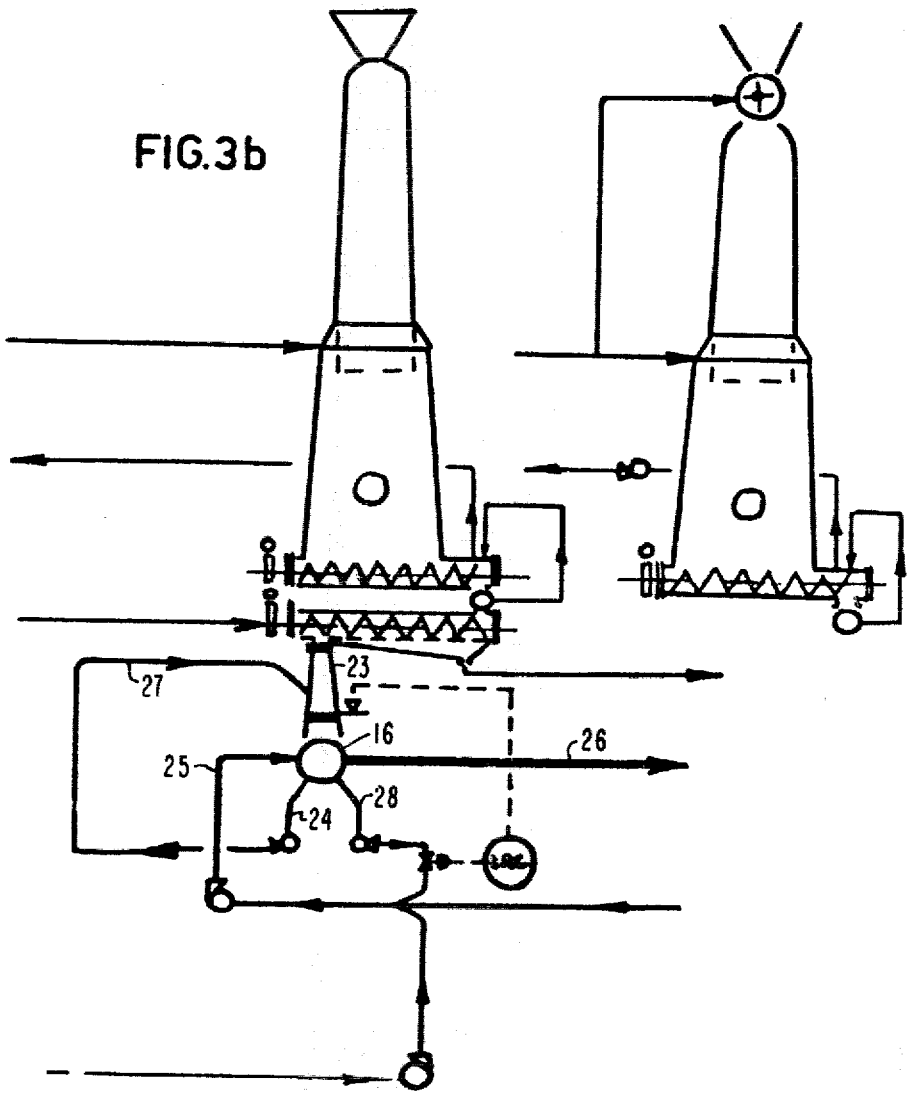

FIG. 3*b* shows a flow chart with combined atmospheric and/or vacuum soaking followed by low-pressure soaking, where two of the six connection fittings in the feed valve housing are provided with screening devices and used for screening off the transporting liquid circulating in the filling circuit.

Figure 4A:
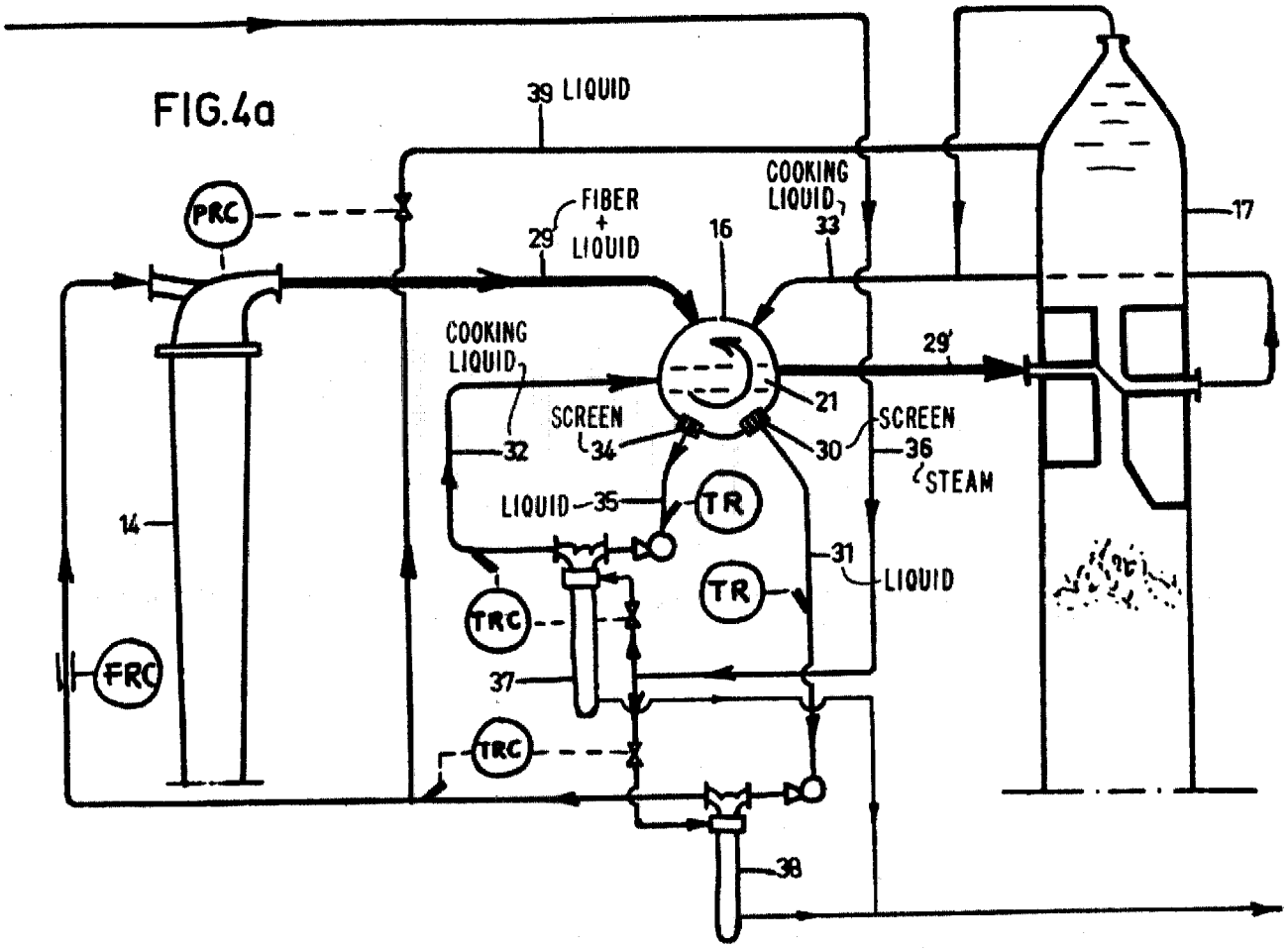
Figure 4B:
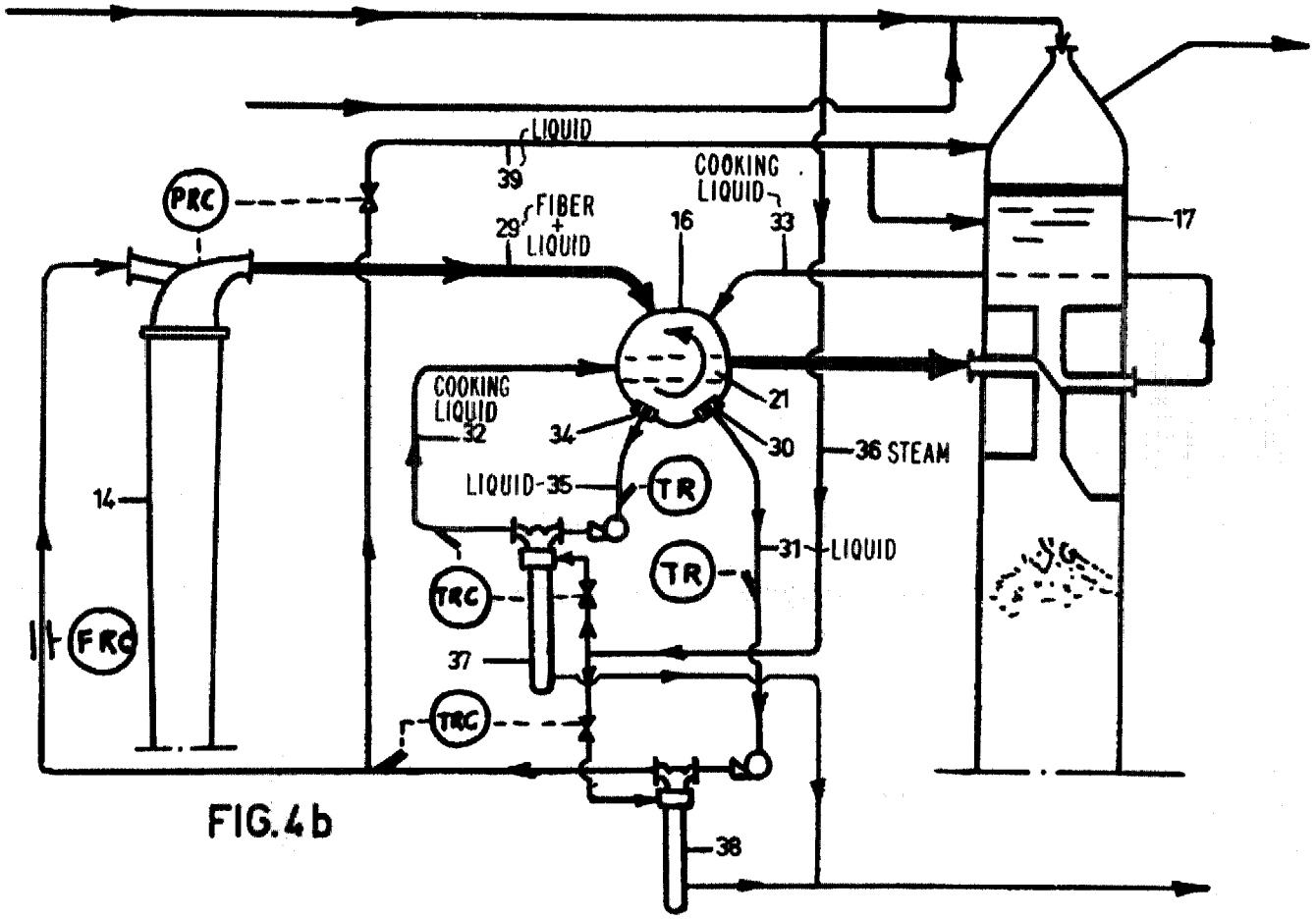

In the plant illustrated in FIGS. 4*a* and 4*b* the fiber material or chips come from the impregnating vessel 14 via a line 29 to the feed valve 16, which rotates counterclockwise. The chips are introduced into the pocket 21 of the feed valve 16 and the transporting liquid (filling circuit) is extracted through the self-cleaning screen 30 and a line 31 and recirculated to the impregnating vessel. In the next position of the pocket 21, shown in dashed lines on the drawing, the chips are carried into the digester 17 with the aid of a circulating liquid (the emptying circuit) consisting of cooking liquor from a line 32. To obtain this cooking liquor, the pocket 21 of the feed valve is supplied in its third position via a line 33 with liquor tapped without screening from the digester, for the purpose of screening off the liquid with which the chips were introduced into the digester via a self-cleaning screen 34 and a line 35. A high-pressure steam supply conducted via a line 36 and heat exchangers 37 and 38 also effects an indirect heating of the circulating liquids, and hence of the chip or fiber material in the pocket 21, right up to the cooking temperature (160° C. to 185° C. depending on the process being used) before the material is introduced into the digester. A line 39 is also provided for maintaining the liquid balance in the feed system. The system is further controlled by means of temperature sensors labeled TR and by temperature and pressure regulators labeled TRC and PRC respectively. A flow regulator is labeled FRC.

The two flow charts 4*a* and 4*b* differ from each other in respect of the actual digesters, that in chart 4*a* being a hydraulically rigid digester completely filled with liquid, while chart 4*b* represents a digester with a separate gas phase in its upper part.

With the system here illustrated and described for feeding fiber material to a treatment vessel such as a digester, the material may be impregnated at the desired low temperature without the impregnation temperature being affected by the subsequent treatment, such as cooking. Further, a final product, such as pulp, of better quality is obtained if the steaming condensate is substantially removed from the steaming vessel before the feed valve, which precedure results in less variation in the concentration of alkali in the digester, and the condensate need not be heated to the cooking temperature and need not be vaporized at the vaporization stage. (See Swedish Patent No. 7411396-0.) The removal of the condensate also reduces the amount of incrustation of the heat-exchanger tubes in the liquor circuits for transporting the fiber material. This results in a lower steam consumption. The steam consumption is further reduced inasmuch as the chips material is heated indirectly to a greater extent through the heating taking place in the feed or rotary valve 16 before reaching the digester.

Figure 6:
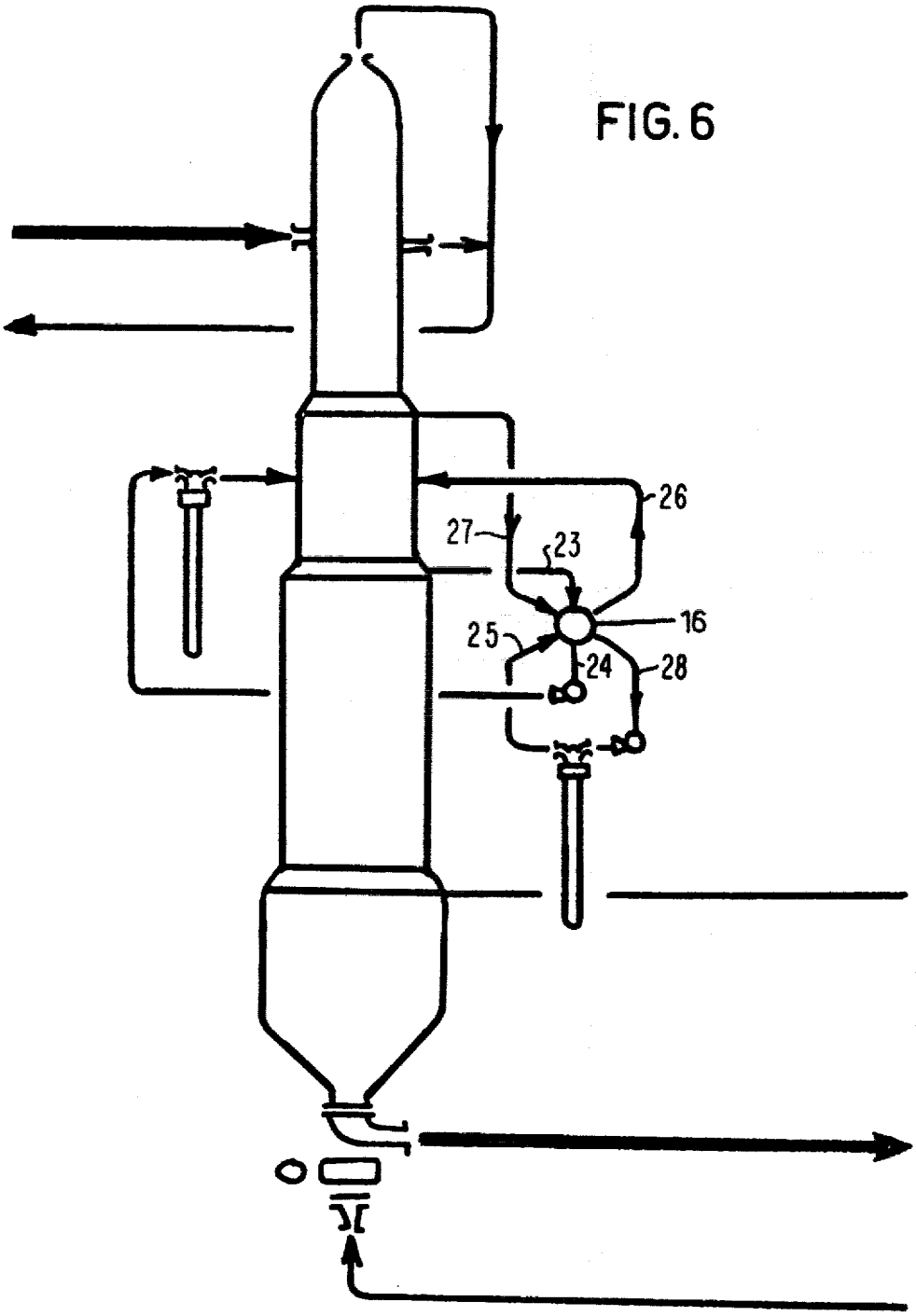

Heating of the fiber material in the valve before the digester causes less steam to be consumed than heating e.g. by means of radial displacement via cooking circuits arranged in the digester itself (see FIG. 6). The quality of the end product, such as pulp, is more even where heating takes place before the digester, and the fiber material yield also increases.

Figure 5:
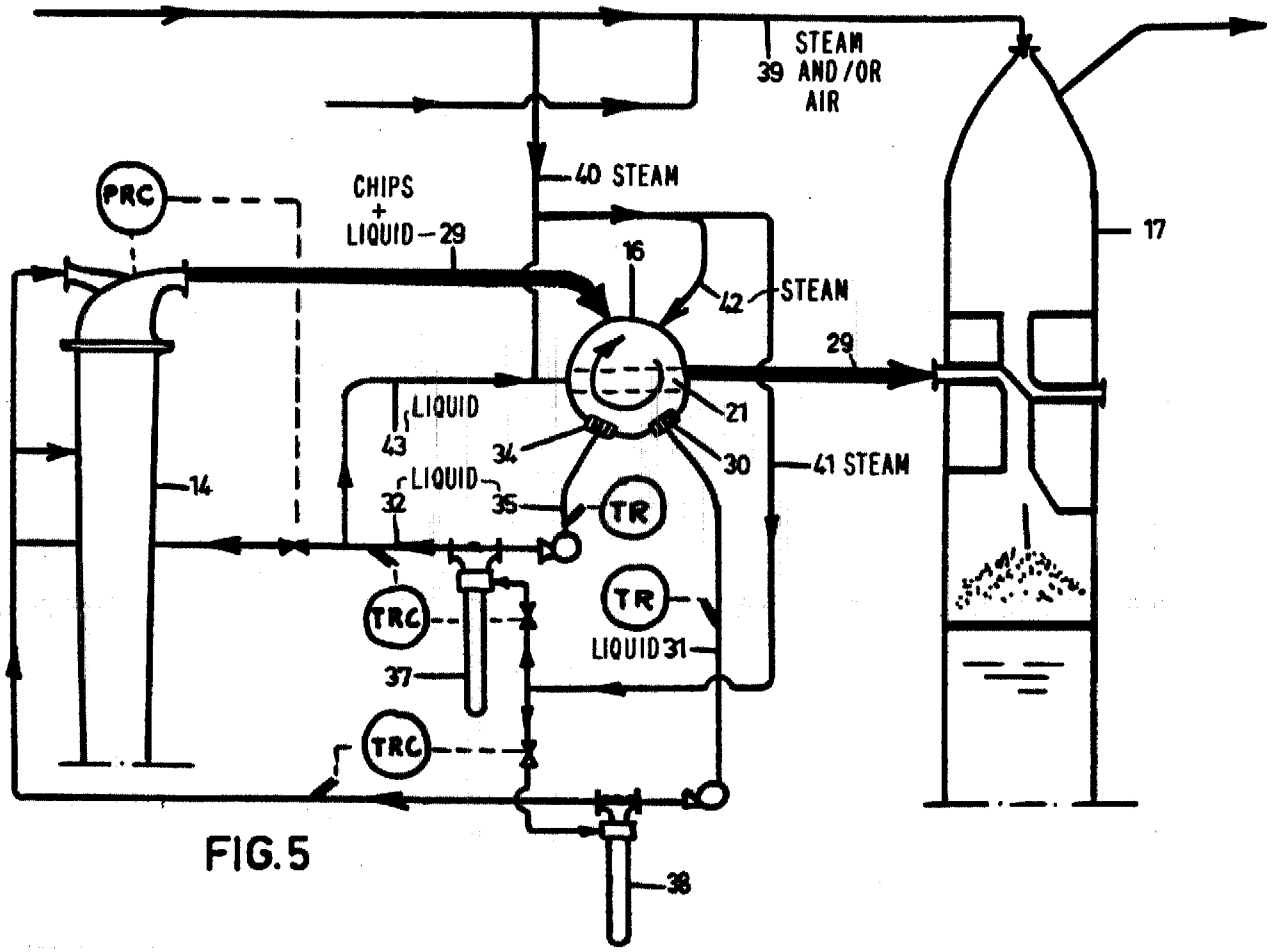

In the plant illustrated in FIG. 5, where parts shared with FIGS. 4*a* and 4*b* are furnished with the same reference labels, the system is shown connected up without a periodic heating stage. In this case, high-pressure steam and/or air is supplied directly via a line 39 to the top of the digester 17, and steam is also supplied via branch lines 40 and 41 to the feed or rotary valve 16 for heating and transport of the fiber material to the digester. The valve 16, which rotates clockwise, is set up so that the pocket 21 is first brought into communication with lines 29 and 30 for the chips to be fed into the pocket and the transporting liquid of the filling circuit to be extracted via line 31 for recirculation to the impregnating vessel 14, after heating in 38 if desired. The pocket is then brought into position between lines 42 and 35, where the chips are heated all the way up to the cooking temperature, 160° C. to 180° C. depending on the process, by means of high-pressure steam from line 42 and the impregnating liquid is tapped via line 35 for recirculation via line 32 to the impregnating vessel 14, at the same time as a fraction of the liquid may be returned via line 43 to the feed valve 16. In the next position the pre-heated chips in the pocket 21 are blown into the digester 17 by high-pressure steam from line 40 and liquid from line 43. This position of the valve pocket 21 is shown in dotted lines on the drawing.

Figure 7:
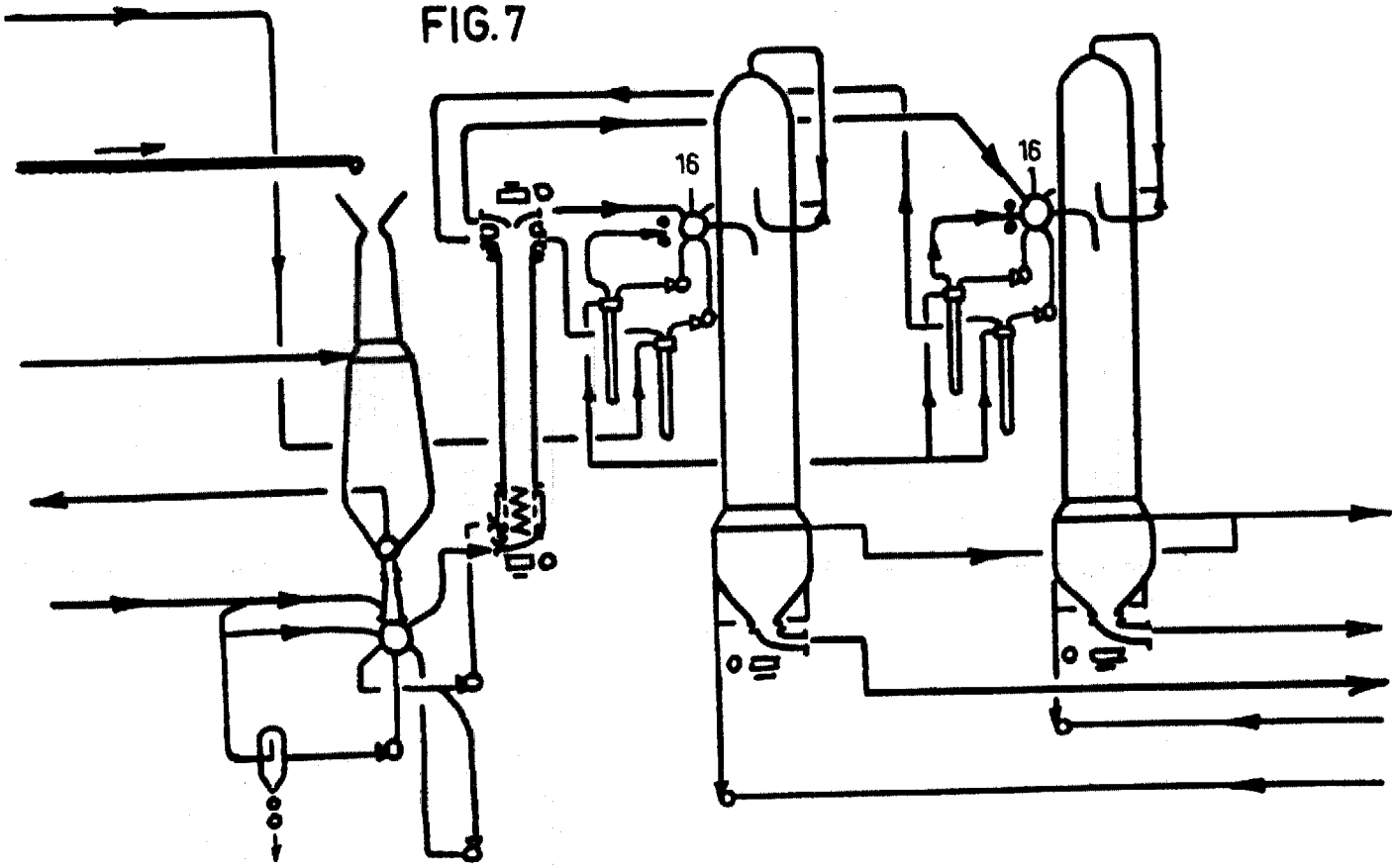

FIG. 7 shows a continuous cooking plant, incorporating this type of feed valve, for producing two different grades of pulp with different yields. Here the steaming and impregnating stages are common to both digesters, but the actual cooling is effected separately in different digesters to enable the pre-impregnated fiber material to be cooked to different qualities and yields and also to enable the total production to be distributed among digesters of the desired capacities.

Figure 8:
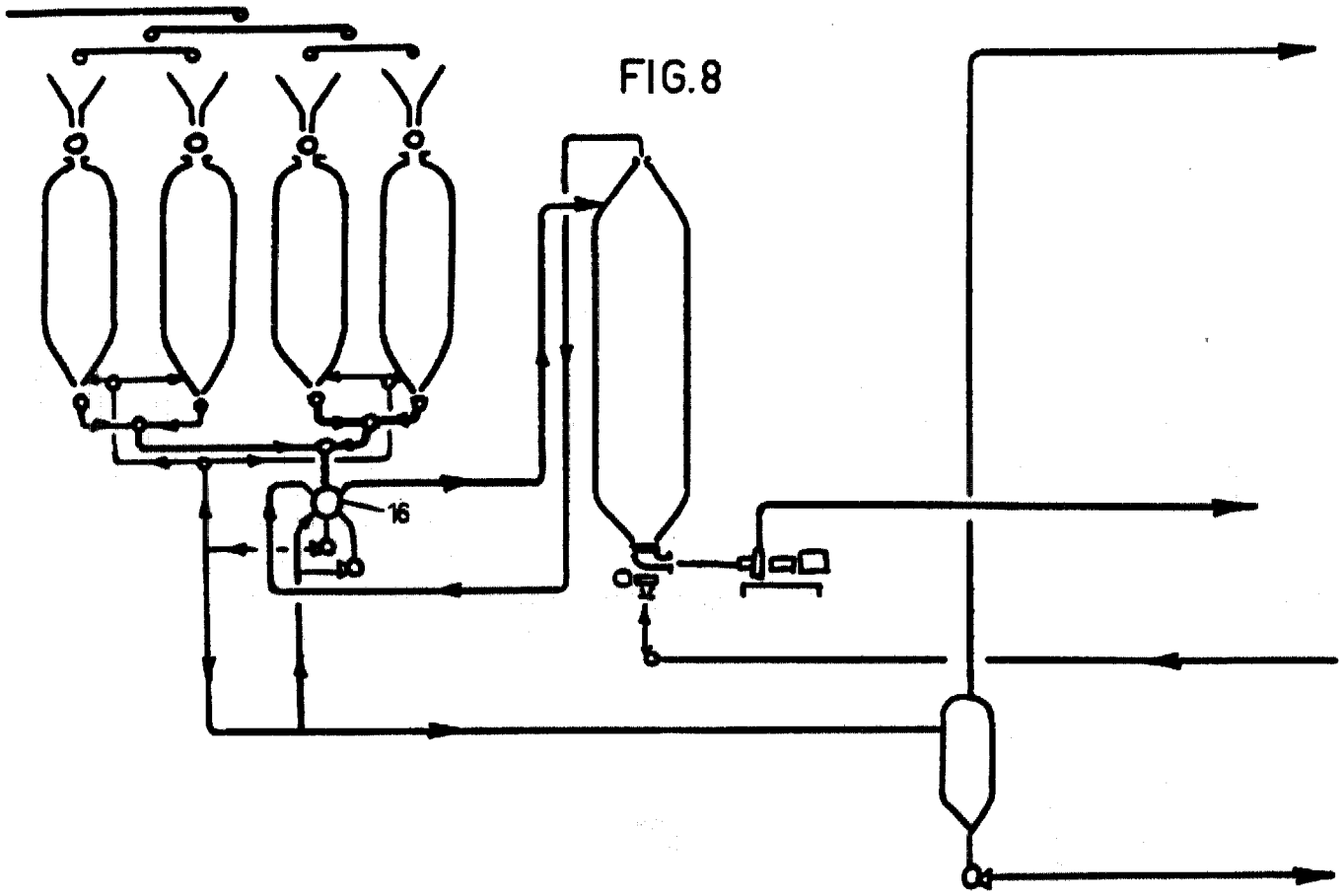

FIG. 8 shows a batch cooking plant with this type of feed valve installed between a batch digester and a free-standing wash tank. By connecting the batch digesters alternately to the feed valve and emptying the fiber material contents of the digesters into the free-standing wash tank a batch digester house can be operated continuously after the wash tank.

FIG. 9 shows a continuous digester house without pre-impregnation. The fiber material is heated to the cooking temperature partly by direct heating by high-pressure steam in the top of the digester and partly by indirect heating by heat exchanger in a cooking circuit passing through a silent digester valve. The digester contains a gas phase in its top section. The gas phase consists of a mixture of the vapor from the cooking process plus the steam and air added for control of the digester pressure. By adding air at the top of the digester it is possible to make the pressure of the gas phase less dependent on temperature. The tapped-off liquor that is conducted to the evaporation plant after the cooking process is displaced by cooler liquid fed to the bottom of the digester from a free-standing wash tank (not shown). The displaced cooking liquor is conducted to the evaporation plant e.g. via an expansion tank which serves as a first evaporation stage. The steam from the expansion tank is used e.g. for hot water preparation, and the condensate with its turpentine content is tapped off and the turpentine reclaimed by conventional decantation of the condensate. The turpentine remaining in the fiber material is reclaimed in subsequent treatment steps such as oxygen delignification.

FIG. 10 shows a continuous digester house with a separate impregnating vessel. In other respects the digester house is similar to FIG. 9.

Figure 11:
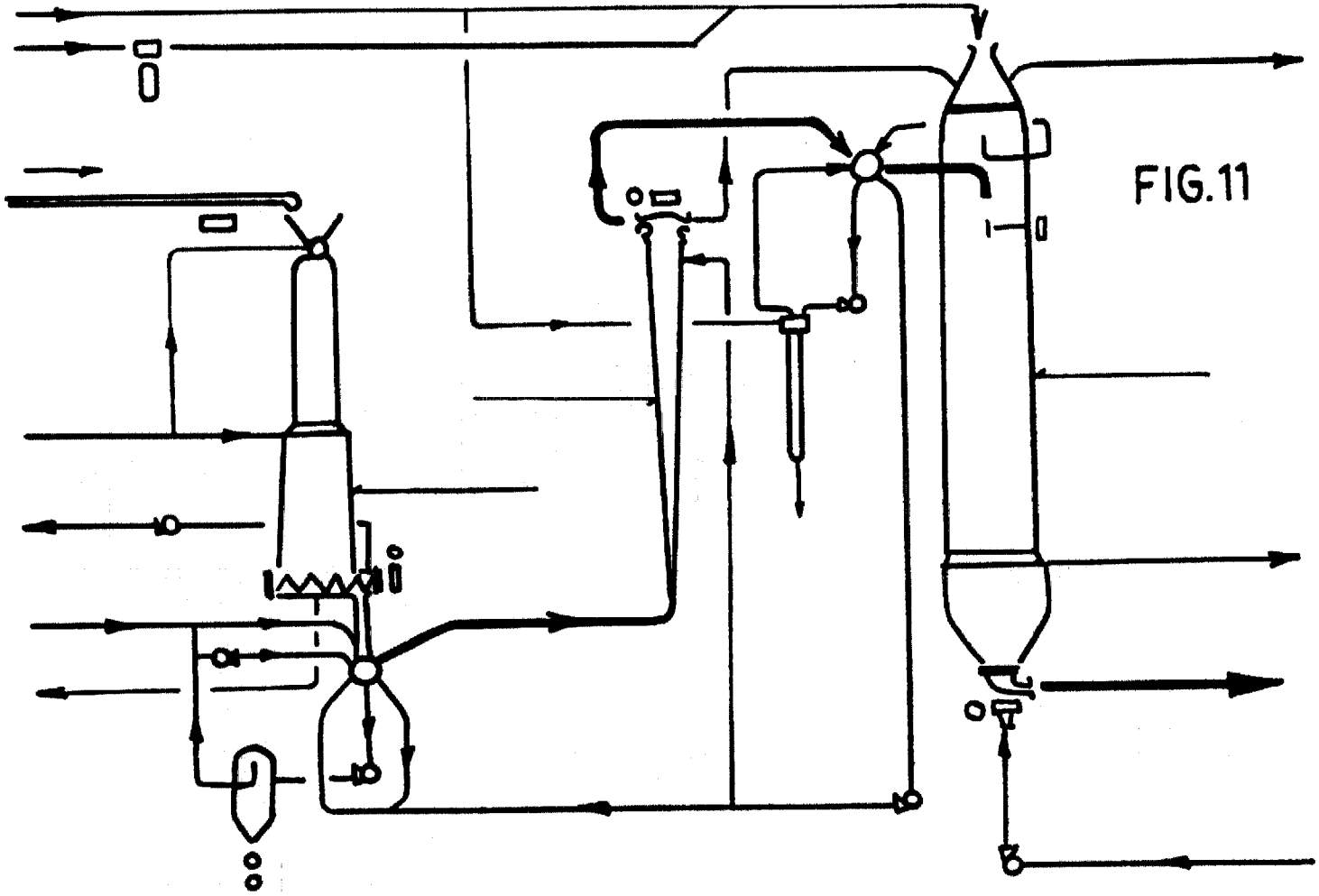

FIG. 11 shows a continuous digester house with vacuum steaming, free-standing impregnating vessel and silent digester valves at the feed-in of fiber material from the vacuum steamer to the impregnator and from the impregnator to the digester. Heating is effected both by indirect means and also directly by high-pressure steam.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A continuous process for transferring a fiber material via a liquid carrier transporting liquid between different treatment steps which comprises:

(a) providing a valve mechanism comprising a housing and rotor having at any one time three flow-through circuits for transporting said fiber material, each circuit consisting essentially of an interconnected inlet, outlet and pocket for transporting said fiber containing carrier liquid, said pocket being a part of said rotor;

(b) introducing from a first treatment step a transporting carrier liquid containing fiber material through an inlet into a pocket while displacing a portion of the carrier liquid through an outlet completing a first or filling circuit, leaving the fiber along with the remaining portion of the carrier liquid in said pocket;

(c) rotating said pocket into a second position and emptying the fiber containing carrier liquid in the pocket into a following treatment step by displacing the fiber and carrier liquid through an outlet from the pocket by a transporting liquid introduced through an inlet into the pocket completing a second or emptying circuit;

(d) once again rotating said pocket into a third position and displacing at least a portion of the transport liquid contents of the pocket through an outlet, said transport liquid being recirculated and reintroduced at the inlet of said second or emptying circuit by the carrier liquid displaced from said first circuit and introduced through an inlet into said pocket in said third position, to complete a third circuit; and (e) continuously repeating steps b through d such that said pocket is always filled with a transport or carrier liquid.

2. The process as disclosed in claim 1 wherein the carrier liquid displaced through said outlets of said first and third circuits passes through self-cleaning screens.

3. The process as disclosed in claim 1 wherein heating of the fiber material is realized by heating the transporting carrier liquid.

4. The process as disclosed in claim 1 wherein cooling of the fiber material is realized by cooling the transporting carrier liquid.

5. The process as disclosed in claim 1, wherein said valve pocket rotates in a clockwise direction.

6. The process as disclosed in claim 1, wherein said valve pocket rotates in a counterclockwise direction.

7. The process as disclosed in claim 1, wherein the transportable material comprises wood chips.

8. A device for continuously transferring a fiber material containing liquid carrier between different treatment steps which comprises a combination:

a valve mechanism comprising a housing and rotor forming at any one time three through circuits for transporting said fiber material, each circuit consisting essentially of an interconnected inlet and outlet of said housing with a pocket in said rotor, means for introducing from a first treatment step a transporting carrier liquid containing fiber material through a first inlet into a pocket while displacing a portion of the carrier liquid through a first outlet completing a first or filling circuit, leaving the fiber along with the remaining portion of the carrier liquid in said pocket, means for emptying the fiber containing carrier liquid from the pocket into a following treatment step by displacing the fiber and carrier liquid through an outlet from the pocket by a transporting liquid introduced through an inlet into the pocket thereby completing a second or emptying circuit, means for displacing at least a portion of the transport liquid contents of the pocket through an outlet, said transport liquid being recirculated and reintroduced at the inlet of said second or emptying circuit by the carrier liquid displaced from said first circuit and introduced through an inlet into said pocket thereby completing a third circuit, and means for continuously rotating the rotor component of said valve mechanism.

* * * * *